US006877916B2

(12) United States Patent
Khaikin

(10) Patent No.: US 6,877,916 B2
(45) Date of Patent: Apr. 12, 2005

(54) METHOD FOR GENERATING NON-REPEATING PATTERNS FOR PRINTING

(76) Inventor: Irena Khaikin, c/210 Tokyo Academic Park, 2-79-41 Aomi, Kono-ku Tokyo 135-0064 (JP)

( * ) Notice: Subject to any disclaimer, the term of this patent is extended or adjusted under 35 U.S.C. 154(b) by 0 days.

(21) Appl. No.: 10/390,337

(22) Filed: Mar. 17, 2003

(65) Prior Publication Data

US 2004/0184857 A1 Sep. 23, 2004

(51) Int. Cl.[7] ..... B41J 11/44; B41J 11/06; B41J 21/17

(52) U.S. Cl. ..... 400/76; 400/61; 400/70

(58) Field of Search ..... 400/76, 61, 70; 101/35; 358/1.18, 1.2; 347/14, 41, 43; 250/492.2

(56) References Cited

U.S. PATENT DOCUMENTS 3,868,496 A * 2/1975 Pugh ..... 377/52
4,324,046 A * 4/1982 Weinberg ..... 33/17 A
5,671,061 A * 9/1997 Hoeller ..... 356/429
5,680,333 A * 10/1997 Jansson ..... 703/6
2003/0058250 A1 * 3/2003 Adams et al. ..... 345/589
2003/0168148 A1 * 9/2003 Gerber et al. ..... 156/71
2004/0047514 A1 * 3/2004 Gallagher et al. ..... 382/270

OTHER PUBLICATIONS

Need I Repeat Myself? Non–Repeating Computer–Aided Designs for Printed Textiles, Hilary Carlisle, The Nottinghan Trent School of Art and Design, UK; Digital Creativity 2001, vol. 12, No. 2, pp 89–98.

International Search Report dated Oct. 12, 2004.

* cited by examiner

*Primary Examiner*—Ren Yan
*Assistant Examiner*—Wasseem H. Hamdan
(74) *Attorney, Agent, or Firm*—Katten Muchin Zavis Rosenman

(57) ABSTRACT

Motifs and patterns are generated by computer and printed an fabric, paper or plastic materials in continuous non-repeating patterns. The data is produced automatically by a random math algorithm, so that each of the printed patterns is similar, but tot identical. The layout is arranged in a random manner, so that every pan of the print is unique and exclusive. The size, color, motifs as well as the level of similarity or variety of the motifs and any other parameter essential to the design are all managed by the software.

16 Claims, 9 Drawing Sheets

6J25
6J1

Angle
6F1
6F21
Degree
Probability

Width
6G1
6G12
Percents

Sequence
6H1
6H9
Times

Interval
6I1
6I12
6I9
Pixels

6E5
6E50
6E51
6E4
6E3
6E2
6E1

6A1
6A24

6B1
6B8
6B17

6C1
6C10

6D1

METHOD FOR GENERATING NON-REPEATING PATTERNS FOR PRINTING

BACKGROUND OF INVENTION

1. Field of the Invention

Generating patterns for printing them on fabric, paper or plastic materials for use in the Apparel, Textile, Décor and Furnishings.

2. Description of the Prior Art

Traditionally textiles are planned and printed with repeating patterns due to both the technological limits and the intended use of the printed material UP until a few years ago, all fabric print production was based on rotary screen printing, with standard roll sizes and therefore standard repeat sizes, particularly in textiles used for decor, that are commonly printed in repeat size of 64 cm. When finally used the repeat is important, as it is necessary to attach me fabrics together, such as in she case of curtains, wherein the left side of the fabric must match the right side.

Recently developed digital printing technology provides for printing designs on fabric directly from a computer, with no added steps. The latest models of digital printers rs can print up to 3.5 meters in width and at a speed of around 55 $m^2$/hour, and thus allow printing that is fast enough to enable mass production. The printing of patterns generated by a computer does not require any specific repeat sizes nor repeat design. For example, printing of graphic banners, advertisements and artworks can be designed and printed in complete form. However, when it comes to the continuous printing of hundreds or thousands of meters, the repeat pattern is the only method used.

The use of repeat limits the design to a repetition of the same design. Therefore when it comes to mass production of apparel, curtains and upholstery it required the use of two or more pieces of repeated fabric attached together, and when an exact match is obligatory, it leads to an inevitable waste of material. Moreover, each such curtain, apparel or upholstery will be identical to another which makes it nonexclusive.

SUMMARY OF THE INVENTION

An object of the present invention is to generate non-repeating patter for continuous printing on fabric, paper, plastic and other materials. This is achieved by using a computerized design process, which starts from creating the motifs by using different mathematical algorithms an organizing the layout into randomly arranged patterns and printing them onto rolls of materials using well-known laser printer or ink printer and similar well-known digital printers. The main object of the invention is to create patters that are both organically balanced, yet endlessly changing. The data is generated automatically by a computer in a way that the outputted patterns are similar, but none of them is identical to another. As the layout of motifs is also arranged endlessly in a random manner, every part of the print is unique. Size, color, and the level of similarity or dissimilarity of the motifs and any other parameters essential to the design are preprogrammed and calculated using a random variable algorithm thus along with commonly processed software.

The algorithm files and the variant for the motifs could be selected for vector or pixel modes, and exported to other design programs such as well-known Adobe Illustrator and Photoshop. This process provides for mass production of printed material, where every product can become an original product that nobody else could possibly ever have. Thanks to the dynamic nature of patterns, the printed material could be calculated for cutting at any length so it can match other cuts that are attached together in an waste reducing way, than the repeated print which must be cut precisely so match the repeat.

Moreover, a chain of non-repeating motifs can be memorized in a computer memory file for reprinting in different colors and materials, or can be printed reversely, left to right, or upside down and negative to positive, providing an extension to the originals or individual numbered copies in variation for the fashion industry, which is novel original concept for generating fashion original and numbered or modified original copies.

DETAILED DESCRIPTION OF THE PREFERRED EMBODIMENTS

Figure 1A:
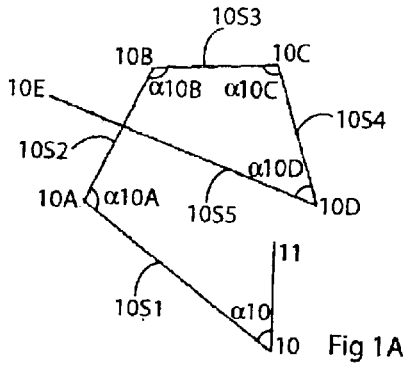
FIG. 1A is a straight segmented line used as an input for a fractal calculation, for the generation of the motif shown in FIG. 1E.

FIG. 1A is an input for the fractal calculation and it is shown as a segmented straight line 10S1 to 10S5. This segmented straight line is calculated on the basis of randomly selected number of points where 10 is the starting point, 10A to 10D are break points and 10E is the end point, angles α10 to α10D and length of segments 10S1 to 10S5.

Figure 2A:
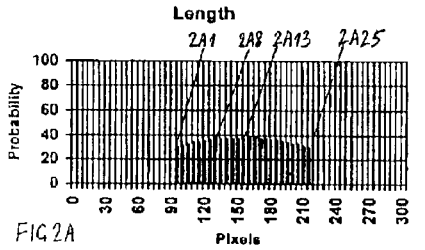
FIGS. 2A, 2B, 2C are an example of three selection tables for the calculation of the inputs as used to generate the fractal motifs.
Figure 2B:
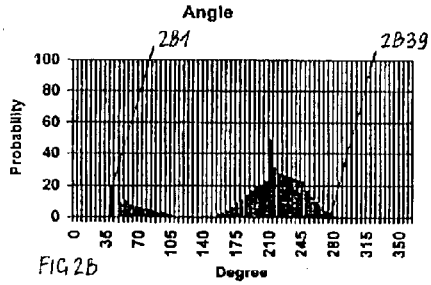
Figure 2C:
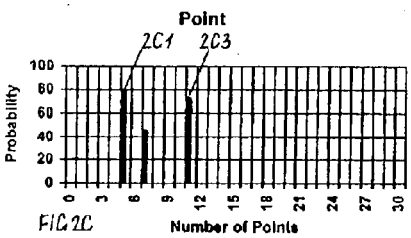
Figure 2D:
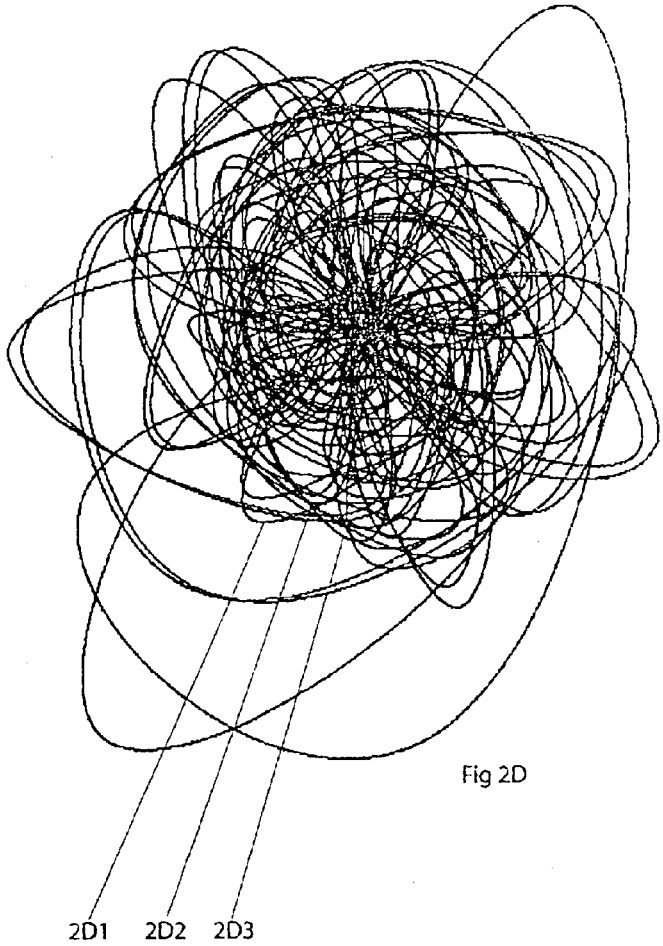
FIG. 2D shows an example of a fractal motif generated through randomly selected length of segments, angles and number of points of FIGS. 2A, 2B and 2C.

The method of setting the necessary data is shown in FIGS. 2A, 2B and 2C. From the starting point 10 of FIG. 1A, the length of the segment is selected randomly from a defined range shown in the graph 2A1 to 2A25 of FIG. 2A. The horizontal axis of the table 2A shows the amount of pixels and the vertical axis indicates relative probability of the selected values. The relative probability means that the probability is calculated on the basis of correlation of the selected values and not to the 100%. Thus, values 2A8 to 2A13 (angles 130° to 155° and probability of 38) of the FIG. 2A will have the same probability, which is higher than the probability of the values 2A1 and 2A25, for example.

The angle of the first segment 10S1 of FIG. 1A is measured from the invisible vertical axis and drawn on the basis of the randomly selected angle from the graph 2B1 to 2B39 of the table of FIG. 2B. The horizontal axis of the table 2B indicates the degree of the angle and the vertical axis indicates relative probability.

Point 10A of the FIG. 1A is a result of the first random selection of the angle and length of the segment of FIGS. 2A and 2B respectively. Similarly, break points 1B, 1C, 1D and the last point 1E are the results of random calculation of the angle and length of the segment.

In the case of segmented straight line 10S1 to 10S5, where starting point 10 is selected randomly and five next points 10A to 10E are the result of random calculation of angle and length, done in rotation, five points needed to be selected, since 10D is actually the last point selected by the computer and 10E is just a result of the fifth calculation of the length of the segment and angle. The number of points was selected randomly from the graph 2C1 to 2C3 of FIG. 2C, where the value 2C1 represents the 5 points. The horizontal axis indicates the number of points and the vertical axis indicates relative probability of the selected values 2C1 to 2C3.

Figure 1B:
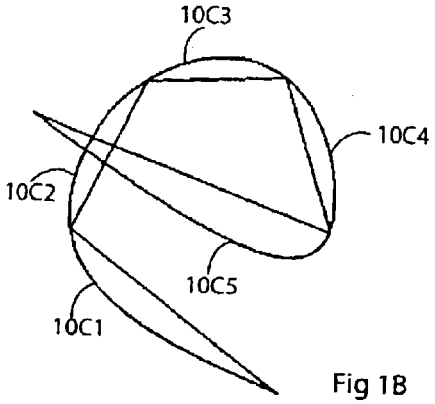
FIG. 1B is a curved line calculated on the basis of straight segmented line shown in FIG. 1A.

FIG. 1B is a curved line 10C1 to 10C5 calculated on the basis of a segmented straight line 10S1 to 10S5 of FIG. 1A, using spline curve algorithm. Since straight line is the primal input, both straight and curved line motifs can be created.

Figure 1C:
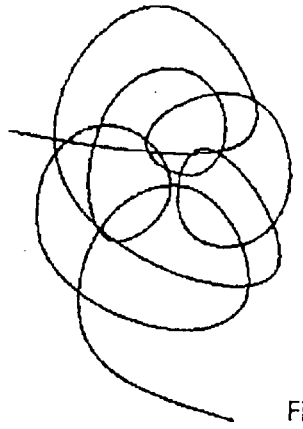
FIGS. 1C and 1D are the calculation result of first and second fractal iteration of the input shown in FIG. 1A.

The curved line 10C1 to 10C5 is an input for the first fractal iteration shown in FIG. 1C.

Figure 1D:
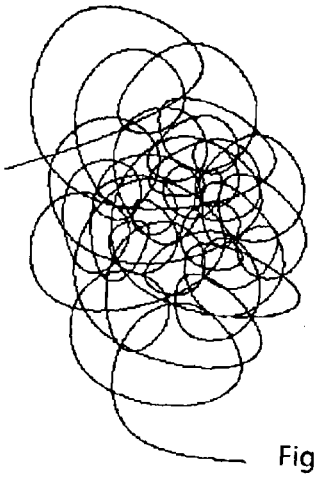

FIG. 1C is an output of the first fractal iteration and an input for the second fractal iteration shown in FIG. 1D.

Figure 1E:
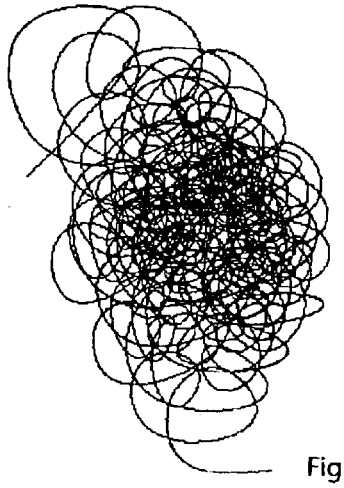
FIG. 1E is a calculated result of third fractal iteration, which is an example of final fractal motifs shown in FIG. 2 and FIG. 3.

Similarly, FIG. 1D is a output of the second fractal iteration and an input for the third iteration, shown in FIG. 1E.

Figure 3:
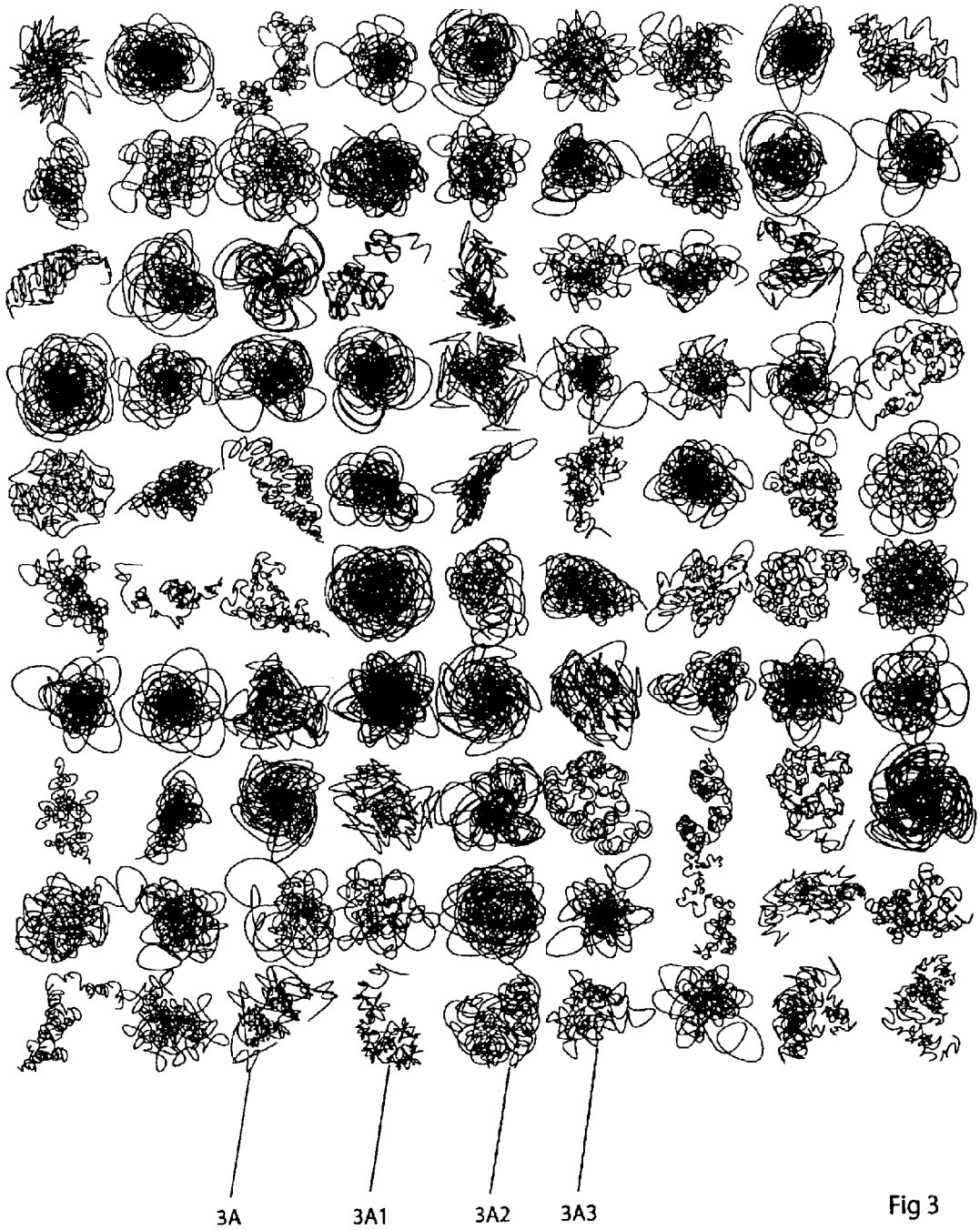
FIG. 3 is an example of a printout of non-repeating motifs resulting form the third fractal iteration of a randomly altered input shown in FIG. 1A.

FIG. 1E is an output of the third iteration and an example of a final motif, such as shown in FIG. 2 and FIG. 3.

FIGS. 2A, 2B and 2C show a method of generating a fractal motif 2D using randomly selected length of segments from the range 2A1 to 2A25 of the table of FIG. 2A, angles 2B1 to 2B39 of the table of FIG. 2B and number of points 2C1 to 2C3 of the table of FIG. 2C. The random selection made by computer from the defined range of length of the segments, angles and number of points shown in the FIGS. 2A, 2B, 2C resulted in a completely different output of the FIG. 2D than the motif shown in the FIG. 1E.

Details 2D1 to 2D3 are an example of lines that become darker, when overlap, creating a three-dimensional effect.

FIG. 3 represents the variety of motifs that could be generated through the randomly calculated alteration of input shown in FIG. 1A, and motifs 3A to 3A33 are an example of non-repeating motifs resulted from third fractal iteration of a randomly altered input.

Figure 4F:
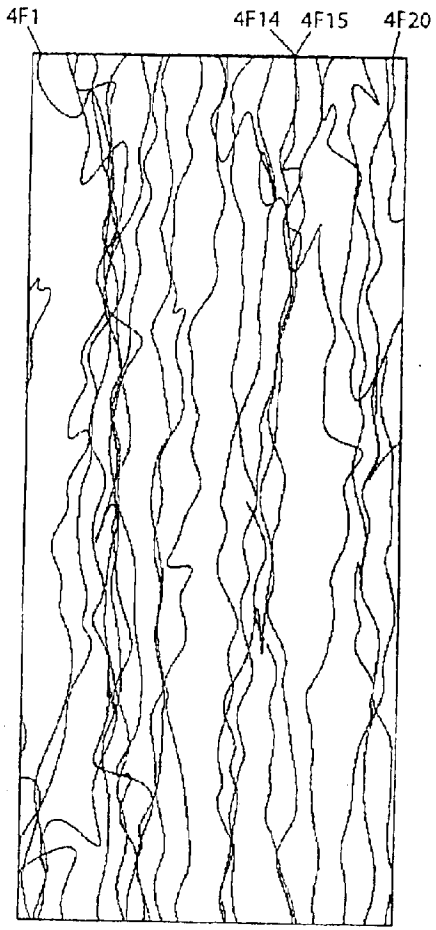
FIG. 4F is yet another example of a randomly generated grid of 20 lines, similar to the 10 line grid of FIG. 4E.
Figure 4E:
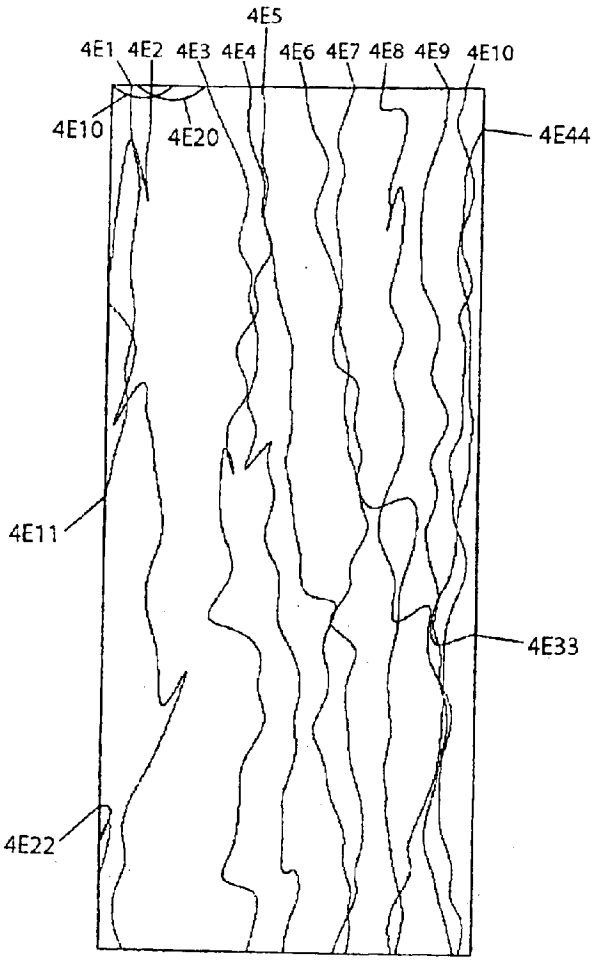
FIG. 4E shows an example of randomly generated grid of lines using randomly selected intervals, deviations, segments and angles, shown in FIGS. 4A, 4B, 4C, 4D, selected for a total of 10 lines.

FIGS. 4A, 4B, 4C and 4D are selection tables used for generating a continuous non-repeating pattern of lines 4E1 to 4E10 of FIGS. 4E and 4F1 to 4F20 of FIG. 4F that are calculated on the basis of randomly selected intervals, deviations, segments and angles. The curved lines 4E1 to 4E10 and 4F1 to 4F20 are calculated on the basis of segmented straight lines using spline curve algorithm.

The starting point of every line 4E1 to 4E10 and 4F1 to 4F20 is selected randomly within the defined distance, which is calculated according to the number of lines and width of the frame. Since a total of 10 lines were selected for the pattern shown in FIG, 4E, the width of the frame is divided in the 10 overlapping areas, such as 4E10, 4E20 and so on. The starting point of the line 4E1 is selected randomly from the area 4E10 and the starting point of the point 4E2 is selected randomly from the area 4E20.

Figure 4A:
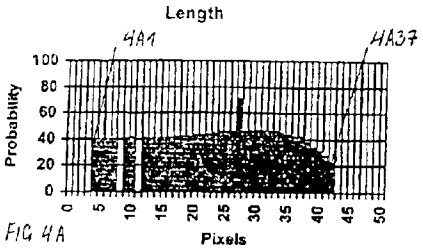
FIGS. 4A, 4B, 4C and 4D are an example of four selection tables for the calculation of the line motifs.

From the starting point, the length of the segment is selected randomly from a defined range shown in the graph 4A1 to 4A37 of the FIG. 4A. The horizontal axis of the table of the FIG. 4A indicates the amount of pixels and vertical axis indicates relative probability.

Figure 4B:
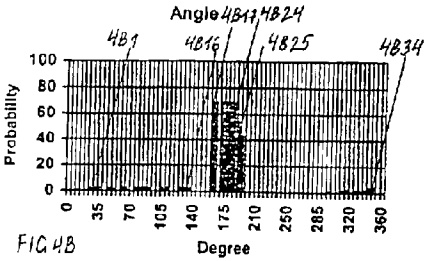

The angle of the first segment is drawn on the basis of randomly selected angle, as shown in the graph 4B1 to 4B34 of the table of FIG. 4B. The horizontal axis of the table of FIG. 4D indicates the degree of the angle and the vertical axis indicates relative probability. The high probability of values 4B17 to 4B24 located in the area of 180° secures the general vertical direction of the lines, while a wide variety of other angles 4B1 to 4B16 and 4825 to 4B34 defines line's intricate character.

Figure 4C:
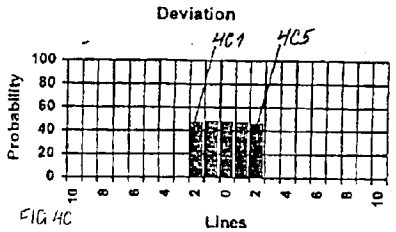

The construction of the straight segmented line, calculated on the basis of randomly selected angle and length of the segments is adjusted according to the amount of interval and deviation. The setting of the necessary data is shown on the table "Deviation" of the FIG. 4C and table "Interval" of the FIG. 4D. The table of the FIG. 4C shows the amount of point located at Interval (n)'s deviation to the left or right from the location of the previous point at Interval (n−1). The horizontal axis of the table of FIG. 4C indicates the number of lines, where value "0" means zero deviation from the previous points and value "1" to the left of "0" means deviation of one line to the left of the previous point. The vertical axis of the table of the FIG. 4C indicates relative probability of the selected values.

Figure 4D:
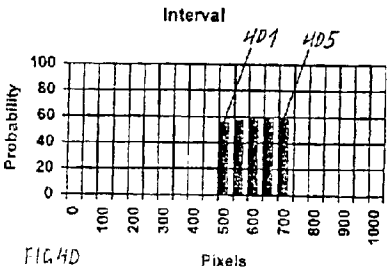

The table of the FIG. 4D shows a distance from the first randomly selected point to the next Interval point the line will pass, which is measured according to the invisible vertical axis. The horizontal axis of the table of the FIG. 4D shows the amount of pixels and vertical axis indicates relative probability. This setting regulates the infinite continuation of the pattern.

Lines 4E11, 4E33 are coming out from the defined frame and lines 4E22, 4E44 are the lines, starting from the opposite side of the frame, in order to maintain the constant number of lines, while creating a dynamic pattern.

FIG. 4F shows a randomly generated grid of lines 4F1 to 4F20, calculated on the basis of the same settings as grid of FIG. 4A, however for a total of 20 lines. Since the starting point of every line 4F1 to 4F20 is selected randomly within the defined areas that overlap each other, as explained earlier for lines 4E1 and 4E2 and overlapping areas 4E10 and 4E20 in the FIG. 4E, it can lead to an overlapping of a two lines' starting point, such as the starting point of lines 4F14 and 4F15.

Figure 5H:
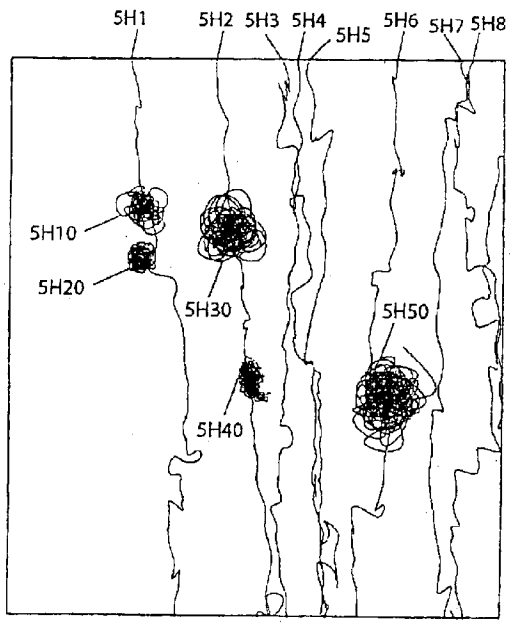
FIG. 5H is an example of another randomly generated pattern, calculated through the same tables used for generating the pattern of FIG. 5G.
Figure 5G:
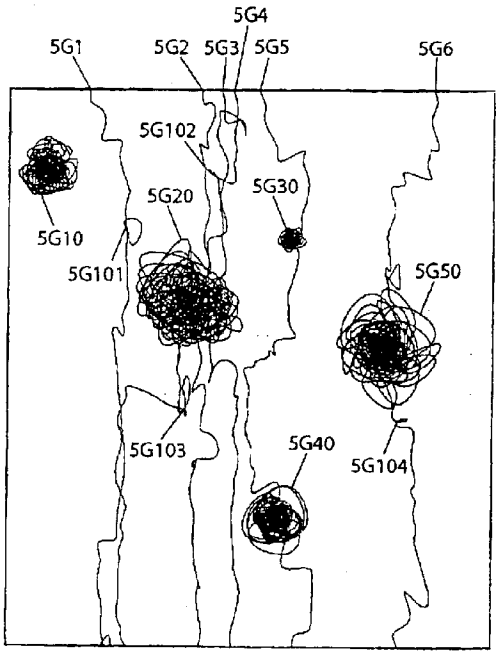
FIG. 5G shows a randomly generated pattern that consist of a grid of lines calculated oa the basis of randomly selected lengths of the segments and angles and includes fractal motifs calculated on the basis of randomly selected length of the segments, angles, size, and number of points, shown in FIGS. 5A, 5B. 5C, 5D, 5E and 5F.

FIG. 5G shows a combined pattern that consists of randomly generated grid of lines 5G1 to 5G6, selected randomly for a total of 6 lines from the defined 5 to 10 lines range, and fractal motifs 5G10 to 5G50.

The pattern of lines is calculated on the basis of randomly selected length of segments and angles. The necessary data is set using table "Random line Angle" of the FIG. 5A and "Random line Length" of the FIG. 5B. The horizontal axis of the table of FIG. 5A indicates the degree of the angle and the vertical axis indicates relative probability. The length of the segments is defined by the graph 5B1 to 5B36 of the table of FIG. 5B. The horizontal axis indicates length of the segments in pixels and the vertical axis indicates relative probability of the selected values. The high probability of the short length segments 5B1 to 5B15 enables the generation of small details, such as loops (details 5G101 to 5G104 of the FIG. 5G).

The fractal motifs 5G10 to 5G50 are generated on the basis of randomly selected angles, length of the segments, number of points and size, using selection tables of FIGS. 5C, 5D, 5E and 5F. The graph 5C1 to 5C28 of the FIG. 5C indicates length of segments, the graph 5D1 to 5D11 of the FIG. 5D indicates the degree of the angle and the graph 5E1 to 5E2 of the FIG. 5E defines the number, of points. The method of calculating a fractal motif, using randomly selected angles, segments and number of points, is shown in FIGS. 1A to FIG. 3.

Figures 5A, 5B, 5C, 5D, 5E, 5F:
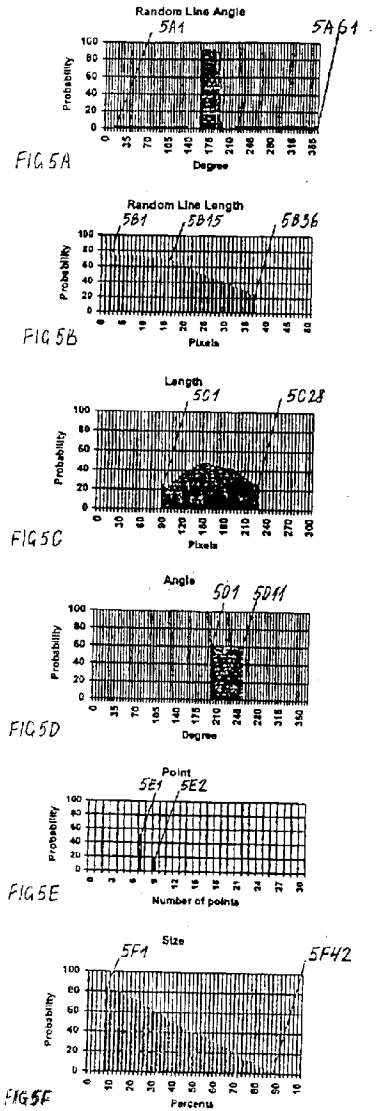
FIGS. 5A. 5B, 5C, 5D, 5E and 5F are a combined example of selection tables for generating lines and fractal motifs in one pattern.

The method of calculating a size of the motif is shown in the graph 5F1 to 5F42 of the table of FIG. 5F. The horizontal axis of the table of FIG. 5F indicates size that is related to the length of the segment shown in the table of FIG. 5C, where a 100% of size is equal to the originally selected length of the segment. Thus value 5F1, for example, will minimize the originally selected length of the segment to 8% of its initial value. Te vertical axis of the table of the FIG. 5F indicates relative probability of the selected values.

FIG. 5H is an example of randomly generated another pattern, calculated through the same selection tables used for generating the pattern of FIG. 5G and consists of randomly generated grid of lines 5H1 to 5H8, selected randomly for a total of 8 lines from the defined 5 to 10 lines range, and fractal motifs 5H10 to 5H50.

Figures 6A, 6B, 6C, 6D, 6E, 6F, 6G, 6H, 6I, 6J:
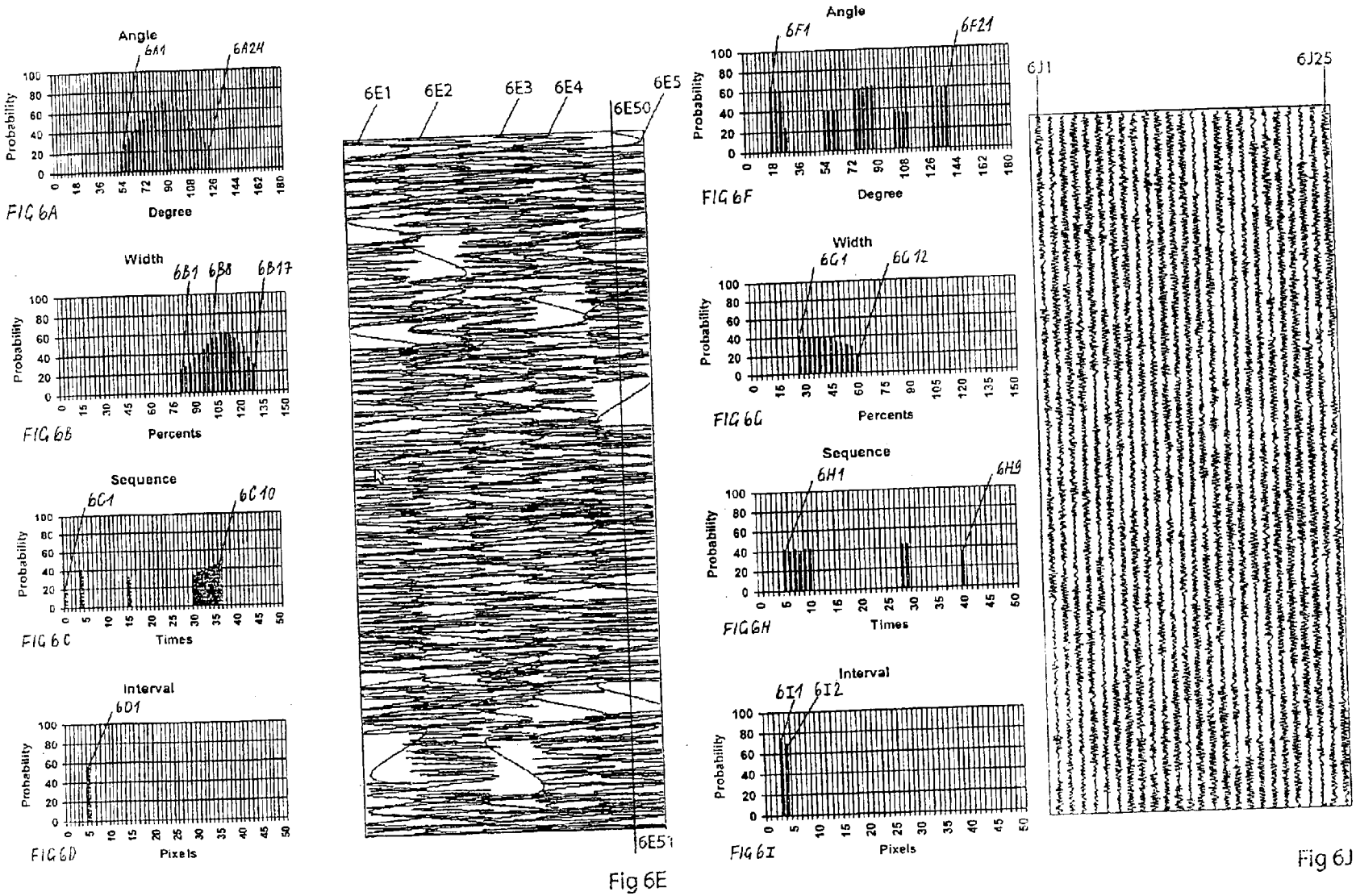
FIGS. 6A, 6B. 6C and 6D are an example of the selection tables used to calculate zigzag lines.
FIG. 6E shows an example of randomly generated layout of five zigzag is using randomly selected angles, sequence, width and intervals, shown in FIGS. 6A, 6B, 6C and 6D.
FIGS. 6F, 6G, 6H and 6I are yet another example of the same tables of FIGS. 6A, 6B, 6C and 6D, bust with different sewing for generating different zigzag pattern as shown in FIG. 6J.
FIG. 6J shows a layout of 25 zigzag lines, generated via same selection tables used for generating the zigzag line of FIG. 6E, but with different setting.

FIG. 6E shows an example of randomly generated layout of 5 zigzag lines 6E1 to 6E5 calculated on the basis of randomly selected angles, sequence, width and intervals, using selection tables of FIGS. 6A, 6B, 6C and 6D.

The defined frame is divided according to the number of zigzags and their width, shown in the FIG. 6B. Zigzag line is generated to the right and left repeatedly from the central vertical axis, such as 6E50 6E51 of the line 6E5 of the FIG. 6E. From the line's starting point, for instance, point 6E50 of the line 6E5, the first segment is drawn according to the angle that has been selected randomly from a defined range shown on the graph 6A1 to 6A24 of the table of FIG. 6A. The horizontal axis of the table of FIG. 6A indicates the degree of the angle and the vertical axis indicates relative probability.

The length of the segment is calculated on the basis of graph 6B1 to 6B17 of the table of FIG. 6B. The horizontal axis indicates the value of width, calculated in percents, and relined to the degree of the angle from the table of FIG. 6A, so that when value of 100% width is selected along with 90° angle, the distance between zigzags is zero. When width of more than 100% is selected as in the graph 6B8 to 6B17, zigzags overlap, as do lines 6E1 to 6E5 of the FIG. 6E and when selected width is less than 100%, the distance between zigzag lines grows, as for lines 6J1 to 6J25 of the FIG. 6J. The vertical axis of the table of the FIG. 6B indicates relative probability of the selected values.

The first randomly selected angle of the segment can be repeated 0 To 37 times according to the value selected randomly from the graph 6C1 to 6C10 of the table of FIG. 6C. The horizontal axis of the table of the FIG. 6C indicates de how many times the selected angle will be repeated and vertical axis indicates relative probability.

The continuation of the zigzag is defined by the amount of interval that is calculated on the basis of the selected value 6D1 of the table of FIG. 6D and measured from the vertical axis such as 6E50 6E51 of the line 6E5. The horizontal axis of the table of FIG. 6D shows the amount of interval in pixels and vertical axis indicates probability, which in this case is not relevant, since only one value 6D1 was selected.

FIG. 6J shows randomly generated layout of 25 zigzag lines 6J1 to 6J25, using a similar method as for generating a pattern shown in FIG. 6E, but with change in the settings for outputting a completely different pattern. FIGS. 6F, 6G, 6F and 6I are an example of the same selection tables of FIGS. 6A, 6B. 6C and 6D, but with different setting. Thus the graph 6G1 to 6G12 of the table of FIG. 6G defines a distance between the zigzag lines. The graph 6F1 to 6F21 of the table of FIG. 6F shows the degree of the angles used to generate a zigzag. The graph 6H1 to 6H9 of the table of FIG. 6H indicates how many times the angle selected from the table of FIG. 6F will be repeated and the graph 6I1 TO 6I2 of the table of FIG. 6I shows the amount of interval.

Figure 7A:
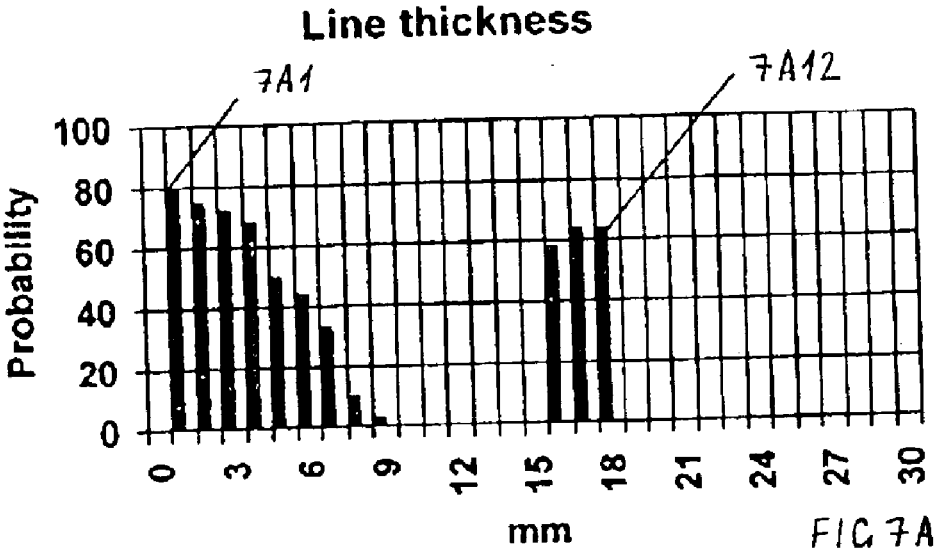
FIGS. 7A and 7B are an example of selection tables for randomly calculating the color and the line thickness of my motif.

Table of the FIG. 7A is an example of a selection table for calculating the line thickness of any motif. The range 7A1 to 7A12 of the table defines the thickness of the line. The horizontal axis shows the thickness of the line in millimeters and vertical axis indicates the relative probability of the selected values.

Figure 7B:
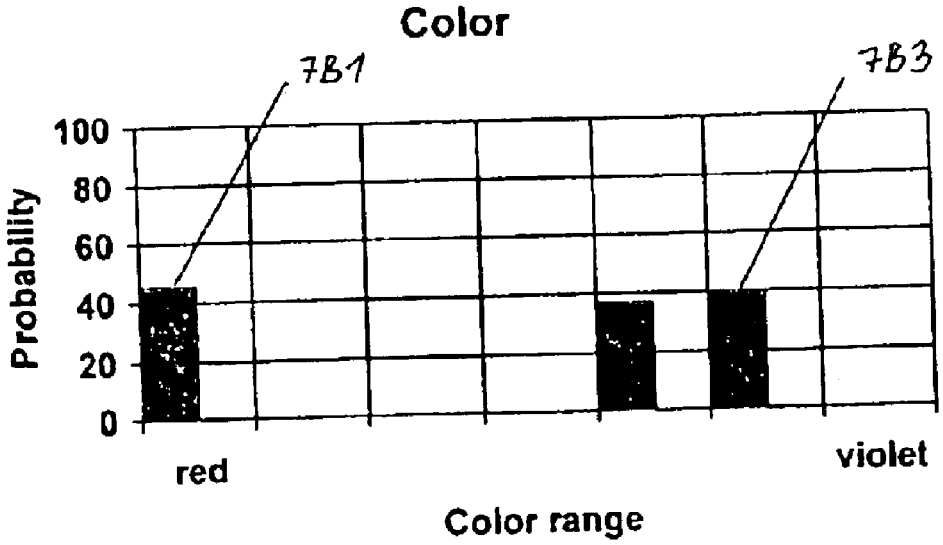

The graph 7B1 to 7B3 of the FIG. 7B is a selection table for calculating the color of the defined motif, or pan of the motif, or part of the layout. The horizontal axis of the table of FIG. 7B indicates the color range from red to violet (red-orange-yellow-green-blue-violet) and the vertical axis indicates relative probability of the selected values.

Figure 8:
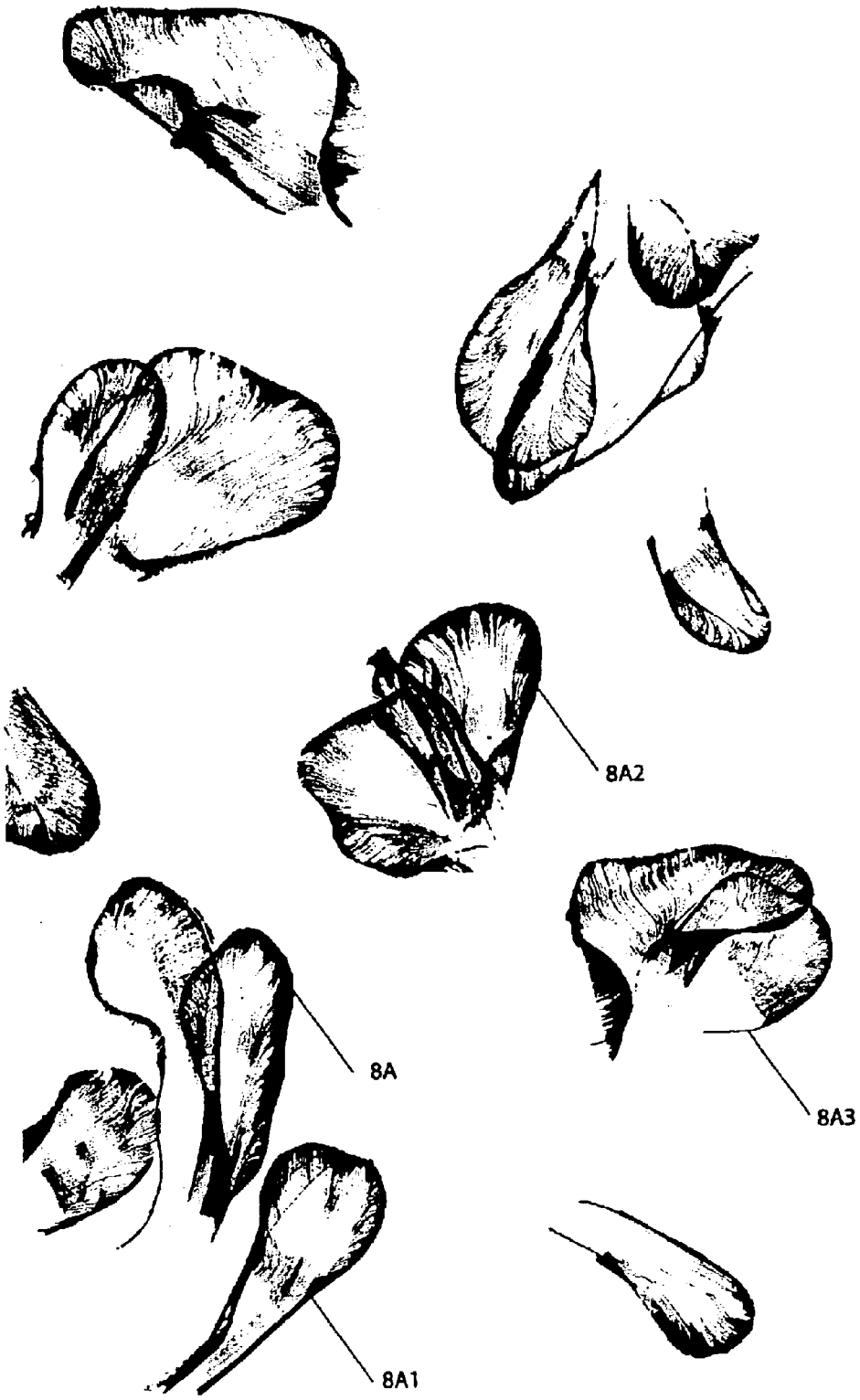
FIG. 8 is an example of a continuous printout of patterns randomly generated using randomly altered non-repeating motifs.

Details 8A, 8A1, 8A2 and 8A3 of the FIG. 8 are an example of randomly altered non-repeating motifs, which arranged randomly in a continuous pattern.

Figure 9:
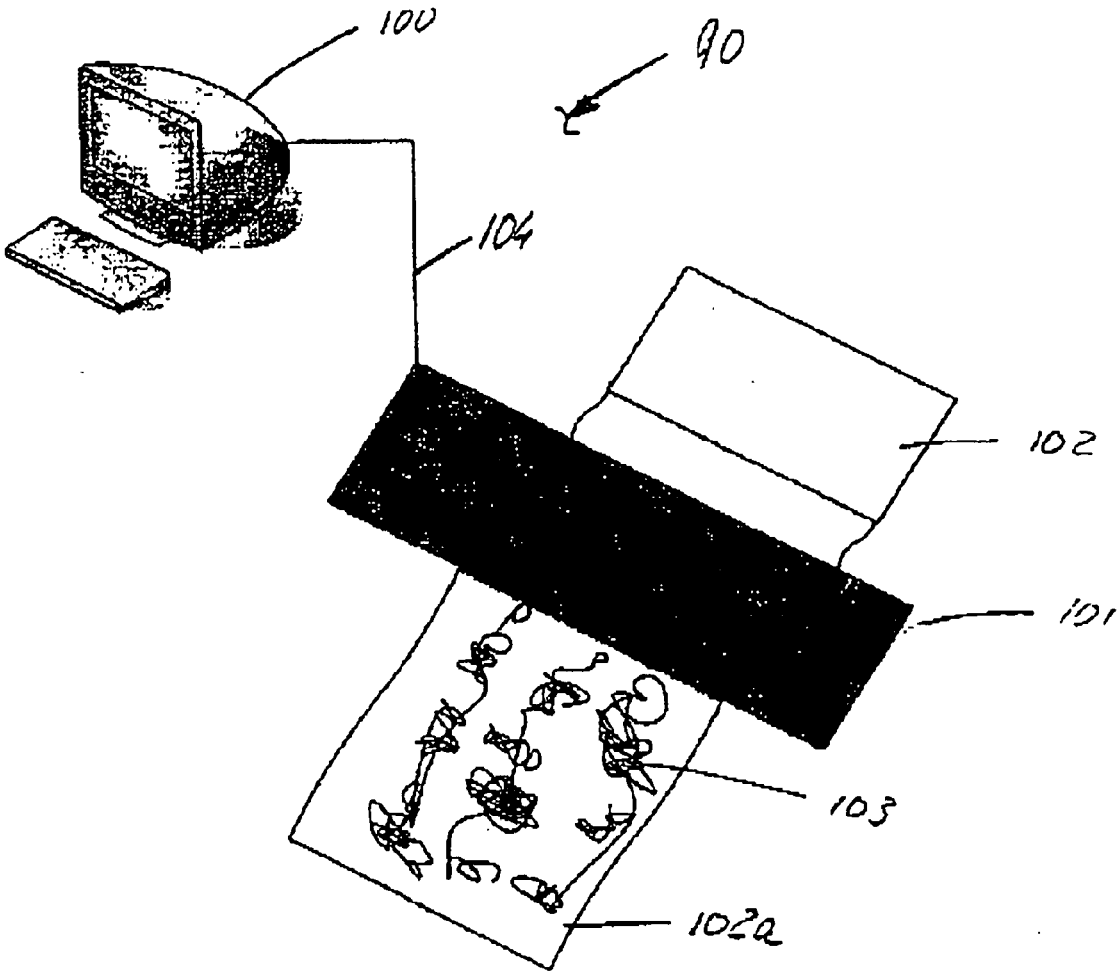
FIG. 9 shows a system of the present invention wherein a computer and a printer are in communication, a roll of cloth is being fed through the printer, and a design is being printed on the cloth.

FIG. 9 shows a system 90 of the present invention wherein a computer 100 and a printer 101 are in communication 104. A roll of cloth 102 is being fed through the printer 101, and the design 103 in accordance with the teachings of the present invention is being printed on the cloth 102*a*.

It should be understood, of course, that the foregoing disclosure relates to one computerized method of generating the patterns, motifs, etc. for the fabrics. It shows the present preferred embodiment such computer generation. However, other computer algorithms and methods could be utilized to generate patterns for the fabrics, which is the concept of the present invention, and that it is intended to cover all such possible methods as well as changes and modifications of the example of the invention herein chosen for the purpose of the disclosure, which modifications do not constitute departures from the sprit and scope of the invention.

What I claim is:

1. A method for printing a non-repeating plurality of design motifs onto cloth by employing a computer in communication with a printer, the method comprising the steps of:

(a) providing a cloth for printing by the printer of said design motif;

(b) selecting said design motif from one of an imaginary art motif, a natural art motif, an object art motif, and a combination thereof, said design motif comprising a plurality of segments;

(c) determining an algorithm on said computer to describe said design motif;

(d) determining a plurality of parameters on said computer for use in said algorithm for a plurality of variations of said design motif, the each of the plurality of parameters comprising a function that is changeable upon input of a variable;

(e) selecting said variable for use in at least one of said plurality of parameters, said variable selected randomly on said computer from a group consisting of size, thickness, width, length, angle, interval, point, line, line angle, line length, line thickness, line width, line interval, sequence, degree, brightness, contrast, color, color range, color level, repeat, repetitiveness and combinations thereof, wherein a first variable is randomly selected to determine the location on said cloth of a first of said plurality of segments and used as input for a subsequent variable;

(f) generating one of said plurality of variations of said design motif on said computer;

(g) repeating steps e and f in order to generate a sequential chain of said plurality of variations of said design motif for printing said non-repeating plurality of design motifs on said cloth;

(h) passing one of said a sequential chain of said plurality of variations of said motif from said computer to said printer; and (i) printing said one of said plurality of variations of said design motif on said cloth in said sequential chain of said non-repeating plurality of design motifs.

2. A method for printing a non-repeating plurality of design motifs according to claim 1, wherein step (a) further comprises selecting said cloth from a group consisting of woven cloth, knitted cloth, press cloth, pressed sheet, molded sheet, extruded sheet, textile material and a combination thereof and made of at least one material selected from a group consisting of cotton, hair, wool, flax, hemp, silk, mohair, synthetic fiber, plastics, paper, pulp, leather, metal foil, metal wire and a combination thereof.

3. A method for printing a non-repeating plurality of design motifs according to claim 2, wherein step (a) further comprises feeding said cloth to said printer in a form selected from a group consisting of roll, cut sheet, formed sheet, sewed cloth and bonded cloth.

4. A method for printing a non-repeating plurality of design motifs according to claim 1, wherein step (a) further comprises selecting said cloth for use as a fabric used for furnishing, the cloth being selected from a group consisting of upholstery, bedclothes, linens, bedcovers, sheets and blankets.

5. A method for printing a non-repeating plurality of design motifs according to claim 4, wherein said non-repeating plurality of design motifs are generated in a reciprocal order for attaching two or more cuts of printed said cloth to each other in a complimentary fit.

6. A method for printing a non-repeating plurality of design motifs according to claim 4, wherein step (i) further comprises the step of storing said sequential chain of said non-repeating plurality of design motifs on said computer for reprinting along with a selected modification to said sequential chain of said non-repeating plurality of design motifs selected from version number printout, copy number printout, up-down reverse printout, left-right reverse printout, positive-negative printout, color variation printout and a combination thereof.

7. A method for printing a non-repeating plurality of design motifs according to claim 1, wherein step (a) further comprises selecting said cloth for home finishing, the cloth being selected from a group consisting of curtains, blinds, shades, carpets, rugs, wall paper, wall covering and a combination thereof.

8. A method for printing a non-repeating plurality of design motifs according to claim 7, wherein said non-repeating plurality of design motifs are generated in a reciprocal order for attaching two or more cuts of printed said cloth to each other in a complimentary fit.

9. A method for printing a non-repeating plurality of design motifs according to claim 7, wherein step (i) further comprises the step of storing said sequential chan of said non-repeating plurality of design motifs on said computer for reprinting modification to said sequential chain of said non-repeating plurality of design motifs selected from version number printout, copy number printout, up-down reverse printout, left-right reverse printout, positive-negative printout, color variation printout and a combination thereof.

10. A method for printing a non-repeating plurality of design motifs according to claim 1, wherein step (a) further comprises selecting said cloth for home finishing, the cloth being selected from a group of material suitable for garments, hosiery, bags and other wearing apparel.

11. A method for printing a non-repeating plurality of design motifs according to claim 10, wherein said non-repeating plurality of design motifs are generated in a reciprocal order for attaching two or more cuts of printed said cloth to each other in a complimentary fit.

12. A method for printing a non-repeating plurality of design motifs according to claim 10, wherein step (i) further comprises the step of storing said sequential chain of said non-repeating plurality of design motifs on said computer for reprinting along with a selected modification to said sequential chain of said non-repeating plurality of design motifs selected from version number printout, copy number printout, up-down reverse printout, left-right reverse printout, positive-negative printout, color variation printout and a combination thereof.

13. A method for printing a non-repeating plurality of design motifs according to claim 1, wherein step (a) further comprises feeding said cloth to said printer in a form selected from a group consisting of roll, cut sheet, formed sheet, sewed cloth and bonded cloth.

14. A method of printing a non-repeating plurality of design motifs according to claim 1, wherein step (c) further comprises selecting a fractal algorithm to describe said design motif.

15. A method of printing a non-repeating plurality of design motifs according to claim 1, wherein step (c) further comprises selecting a spline curve algorithm to describe said design motif.

16. A method of printing a non-repeating plurality of design motifs according to claim 1, wherein step (c) further comprises determining said algorithm to describe said design motif utilizing one of a vector mode and a pixel mode.

* * * * *